US010883698B2

(12) United States Patent
Trevino

(10) Patent No.: US 10,883,698 B2
(45) Date of Patent: Jan. 5, 2021

(54) HEAD FOR A CHILDREN'S CLIP LIGHT

(71) Applicant: Nicole Trevino, Raymondville, TX (US)

(72) Inventor: Nicole Trevino, Raymondville, TX (US)

(73) Assignee: Nicole Treviño

( * ) Notice: Subject to any disclaimer, the term of this patent is extended or adjusted under 35 U.S.C. 154(b) by 0 days.

(21) Appl. No.: 15/978,123

(22) Filed: May 12, 2018

(65) Prior Publication Data

US 2018/0328567 A1 Nov. 15, 2018

Related U.S. Application Data

(60) Provisional application No. 62/602,933, filed on May 12, 2017.

(51) Int. Cl.

| | |
|---|---|
| ***F21V 3/02*** | (2006.01) |
| ***F21V 21/088*** | (2006.01) |
| ***F21V 17/12*** | (2006.01) |
| ***F21V 17/00*** | (2006.01) |
| ***F21L 4/04*** | (2006.01) |
| *F21Y 115/10* | (2016.01) |
| *F21W 121/00* | (2006.01) |

(52) U.S. Cl.

CPC ..... *F21V 3/02* (2013.01); *F21L 4/04* (2013.01); *F21V 17/002* (2013.01); *F21V 17/12* (2013.01); *F21V 21/0885* (2013.01); *F21W 2121/00* (2013.01); *F21Y 2115/10* (2016.08)

(58) Field of Classification Search

CPC ..... F21V 3/02

See application file for complete search history.

(56) References Cited

U.S. PATENT DOCUMENTS

| | | | | |
|---|---|---|---|---|
| 5,980,072 | A * | 11/1999 | Zirkle | B63B 45/06 362/363 |
| 7,132,084 | B1 * | 11/2006 | Roumpos | A61L 9/02 422/125 |
| 7,473,002 | B1 * | 1/2009 | Chen | F21S 10/00 362/283 |
| 2008/0062703 | A1 * | 3/2008 | Cao | F21K 9/232 362/311.06 |
| 2010/0135024 | A1 * | 6/2010 | Gier | F21V 3/02 362/294 |
| 2011/0242798 | A1 * | 10/2011 | Ortega | F21V 21/32 362/98 |
| 2011/0261560 | A1 * | 10/2011 | Muccianti | F21S 6/00 362/190 |
| 2016/0047525 | A1 * | 2/2016 | Wang | F21V 5/04 362/311.06 |

OTHER PUBLICATIONS

WOMHOPE Childrens lights, www.amazon.com/WOMHOPE-Childrens-Lights-Hand-held-Vibration/dp/B017AYFUX0/ (Year: 2015).*

* cited by examiner

*Primary Examiner* — Charlie Y Peng

(57) ABSTRACT

A head, for a clip light, that includes a transparent twist on top that can be an animal, cartoon character, or inanimate object followed by a white plastic in the shape of a light bulb, which has an internal housing with an LED light attached and then is twisted onto the bottom of the head.

1 Claim, 3 Drawing Sheets

HEAD FOR A CHILDREN'S CLIP LIGHT

CROSS-REFERENCE TO RELATED APPLICATIONS

This application claims the benefit of and priority to U.S. Provisional Patent Application No. 62/602,933.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not applicable.

BACKGROUND OF THE INVENTION

The present invention relates to the head of a clip light.

BRIEF SUMMARY OF THE INVENTION

The primary objective of the present invention is to provide entertainment or comfort for children and infants by using various animals, cartoon characters, or inanimate objects for the top of the head that is for a clip light.

Another objective of the present invention is to aid parents while driving by helping to soothe crying infants or children.

DETAILED DESCRIPTION OF THE INVENTION

Figure 1:
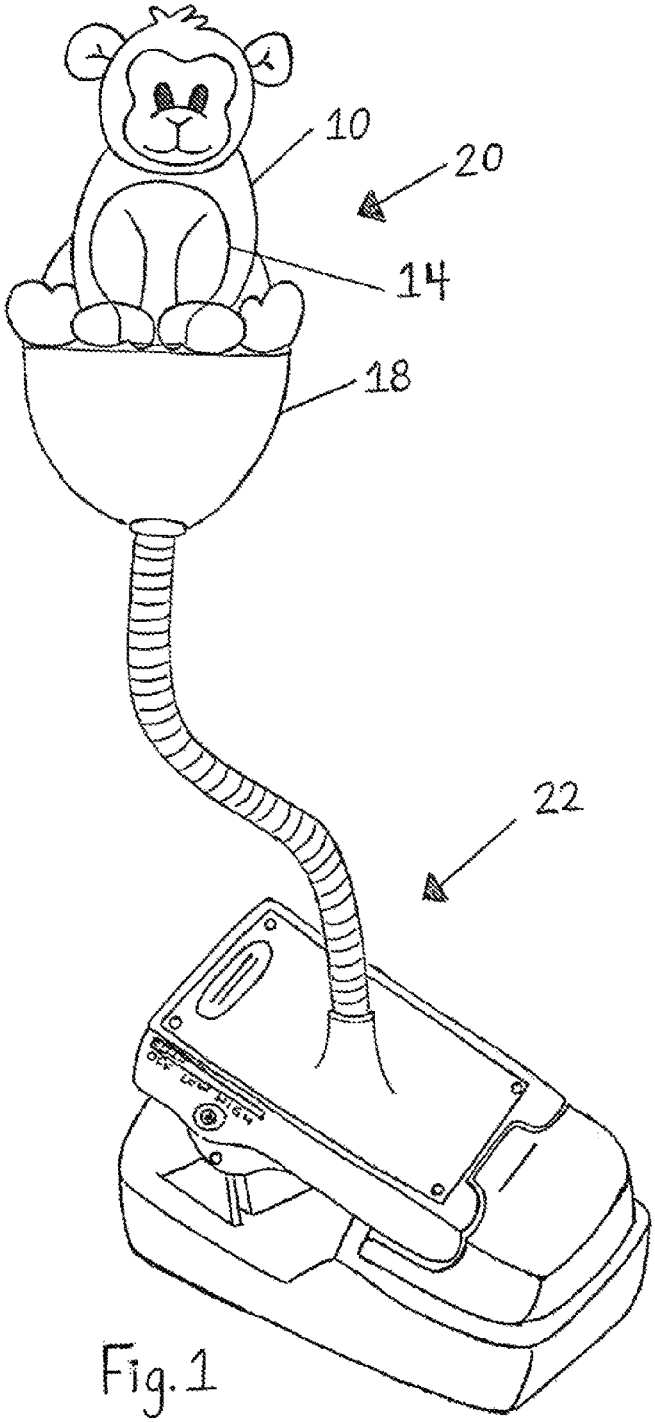
FIG. 1 is a perspective view showing a way my invention can be used with a flexible goose neck and clip that is meant for a rechargeable clip light.

FIG. 1 illustrates a perspective view example of a way my invention 20 can be used with a flexible goose neck and clip that is meant for a rechargeable clip light 22. The top is in the shape of a monkey 10 and is also transparent, revealing the white plastic shaped like a light bulb 14 underneath it. The top can be various other animals, cartoons characters, or inanimate objects and is twisted onto the bottom of the head 18.

Figure 2:
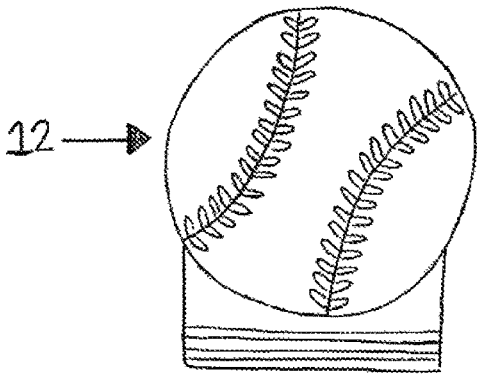
FIG. 2 is a front view of the top to my invention in the shape of a baseball.

FIG. 2 illustrates a front view of the top to my invention as a baseball 12. Therefore, it shows my invention as an inanimate object.

Figure 3:
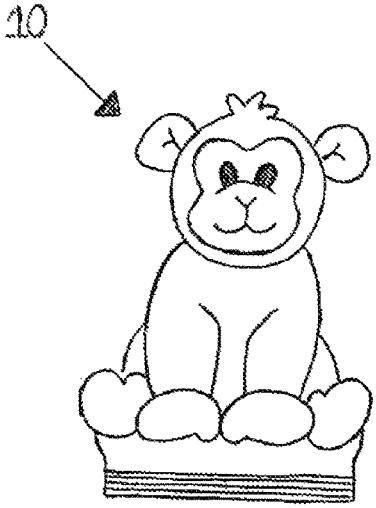
FIG. 3 is a front view of the top to my invention in the shape of a monkey.

FIG. 3 illustrates a front view of the top to my invention in the shape of a monkey 10, which is separated from the bottom part of my invention.

Figure 4:
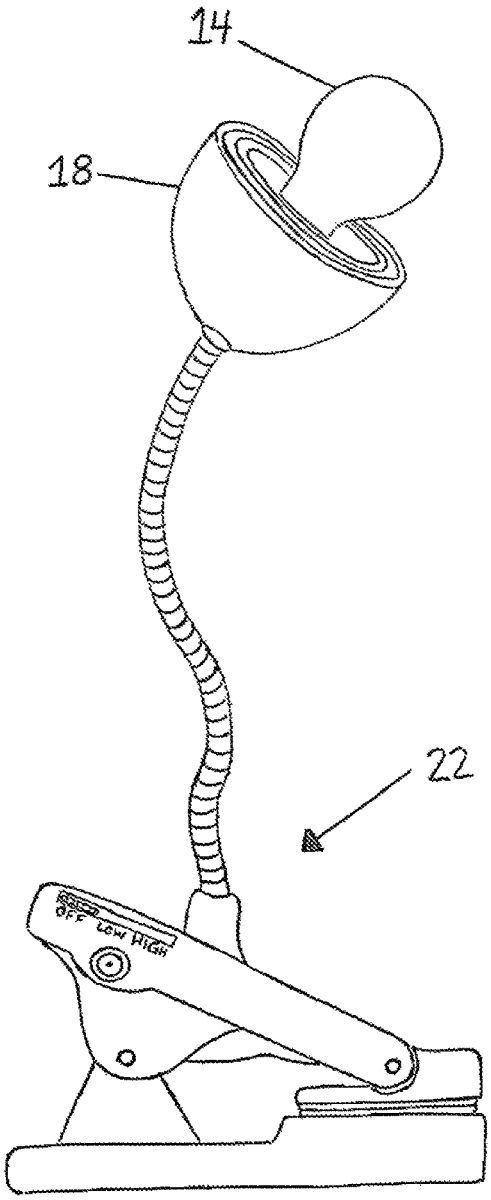
FIG. 4 is a left side view showing a way my invention without the top can be used with a flexible goose neck and clip that is meant for a rechargeable clip light.
Figure 5:
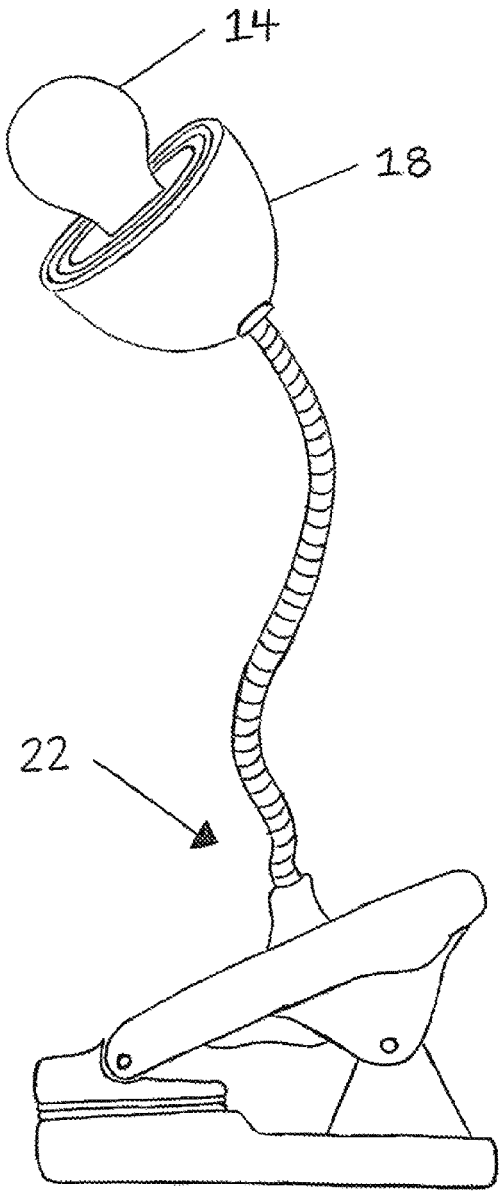
FIG. 5 is a right side view showing a way my invention without the top can be used with a flexible goose neck and clip that is meant for a rechargeable clip light.

FIG. 4 and FIG. 5 illustrate examples of the left and right side views of my invention without the top along with a flexible goose neck and clip that is meant for a rechargeable clip light 22. A white plastic shaped like a light bulb 14 is twisted onto the bottom of the head 18.

Figure 6:
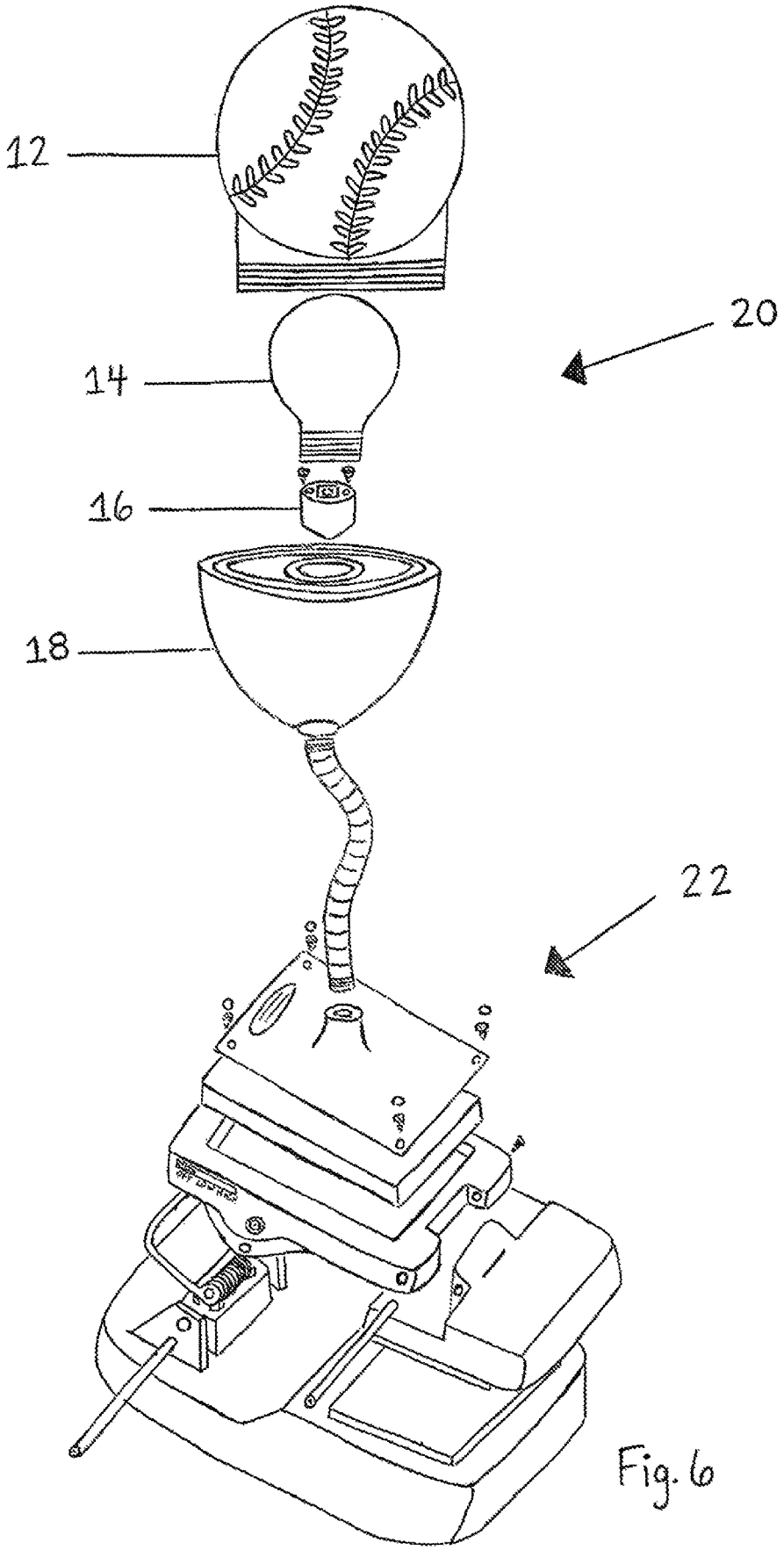
FIG. 6 is an exploded perspective view showing a way my invention can be used with a flexible goose neck and clip that is meant for a rechargeable clip light.

FIG. 6 illustrates an exploded perspective view of a way my invention can be used with a flexible goose neck and clip that is meant for a rechargeable clip light 22. First, there is the top which is in the shape of a baseball 12 followed by a white plastic in the shape of a light bulb 14. Then, there is the internal housing 16, which has an LED light attached to it. Last there is the bottom of the head 18, which is where the baseball 12 and the white plastic shaped like a bulb 14 are twisted onto.

The invention claimed is:

1. A rechargeable clip light comprising:

a clip;

an enclosure in the clip for housing a power source;

a flexible goose neck attached to the clip;

a light head having a bottom portion and a detachable top portion;

a white plastic enclosure shaped like a light bulb for housing an LED disposed on the bottom portion;

wherein the bottom portion is attached to the flexible goose neck;

wherein the detachable top portion is shaped as animals, cartoon characters, or inanimate objects; and wherein the detachable top portion is fastened onto or removed from the bottom portion by a twisting action.

* * * * *